United States Patent [19]

Craig et al.

[11] Patent Number: 5,007,320

[45] Date of Patent: Apr. 16, 1991

[54] COMPASS

[75] Inventors: Stuart Craig, Willowdale; Earl Helland, Toronto, both of Canada

[73] Assignee: Inventive Ideas Incorporated, Toronto, Canada

[21] Appl. No.: 369,235

[22] Filed: Jun. 22, 1989

Related U.S. Application Data

[63] Continuation-in-part of Ser. No. 209,956, Jun. 22, 1988, abandoned.

[51] Int. Cl.[5] ..... B26D 5/00

[52] U.S. Cl. ..... 83/745; 83/591; 30/310

[58] Field of Search ..... 83/591, 490, 594, 596, 83/555, 564, 553, 745; 30/310, 289; 33/27.03, 27.02, 27.07

[56] References Cited

U.S. PATENT DOCUMENTS

| | | | |
|---|---|---|---|
| 115,157 | 5/1871 | Brown et al. . | |
| 365,441 | 6/1887 | Larsh . | |
| 915,611 | 3/1909 | Lane . | |
| 2,463,024 | 3/1949 | Monte et al. . | |
| 2,537,455 | 1/1951 | Genovese . | |
| 2,624,117 | 1/1953 | Paci . | |
| 2,799,929 | 7/1957 | Kurianski . | |
| 2,821,019 | 1/1958 | Immink . | |
| 2,857,674 | 10/1958 | Feldhake . | |
| 2,958,132 | 11/1960 | Hartbauer et al. . | |
| 3,171,200 | 3/1965 | Poppenga . | |
| 3,289,299 | 12/1966 | Elger . | |
| 3,315,357 | 4/1967 | Jenigen . | |
| 3,460,261 | 8/1969 | Frey . | |
| 3,621,574 | 11/1971 | Yanke et al. . | |
| 3,760,499 | 9/1973 | Crain, Jr. . | |
| 3,768,357 | 10/1973 | McBride | 83/438 |
| 4,060,893 | 12/1977 | Matsuura . | |
| 4,173,913 | 11/1979 | Nicholson . | |
| 4,175,330 | 11/1979 | Hermann . | |
| 4,241,506 | 12/1980 | LeBlanc et al. . | |
| 4,426,781 | 1/1984 | Kufrin . | |
| 4,530,156 | 7/1985 | Kettlestrings . | |
| 4,593,467 | 6/1986 | Safer . | |
| 4,773,798 | 9/1988 | Gaster et al. . | |
| 4,782,730 | 11/1988 | Picone et al. | 83/745 |

*Primary Examiner*—Hien H. Phan
*Assistant Examiner*—John M. Husar
*Attorney, Agent, or Firm*—Fleit, Jacobson, Cohn, Price, Holman & Stern

[57] ABSTRACT

A compass for sweeping an arc of a circle on a sheet of material comprises an annular base having a lower surface engageable with the material. A support member is rotatably supported on the base and a toolholder is mounted on the support member. The toolholder is moveable with the support and upon rotation of the support relative to the base, sweeps an arc of a circle. The toolholder has a toolpost to support a tool and permit movement of the tool relative to the support member in a direction generally normal to the sheet of material to facilitate movement of a tool mounted in the holder into and out of engagement with the sheet of material.

26 Claims, 15 Drawing Sheets

COMPASS

This application is a continuation-in-part of application Ser. No. 07/209,956 filed on June 22, 1988, now abandoned.

The present invention relates to compasses, and in particular to compasses for sweeping circles on a sheet of material.

The most common form of compass has a pair of hinged legs with a point at the distal end of one leg to centre the instrument and an implement such as a pencil lead at the opposite end. However, in certain applications such as graphic arts, it is undesirable to leave a hole in the material at the centre of the circle which is being swept and it is therefore necessary to provide a compass which will not damage the material being used.

Previous arrangement of such compasses are shown in U.S. Pat. Nos. 3,621,574 to Yanke et al; 4,060,893 to Matsuura and 4,173,913 to Nicholson. In the Yanke et al patent a cutter is arranged at the end of an arm centred on a base plate. However, this has the disadvantage that the relatively small radiuses cannot be cut because of the size of the base which must be relatively large to allow the compass to be manipulated. The patents to Matsuura and Nicholson each require a small sample of material to be placed within the instrument, which is not satisfactory when large sheets of material are being handled. Moreover, there is no provision in either Nicholson or Matsuura for adjustment of the blade once the material has been inserted in the instrument as closing of the body causes a blade to penetrate the material.

An alternative approach to cutting circles is to use a plug cutter in which a blade is moveable vertically relative to a body as disclosed in U.S. Pat. Nos. 3,760,499; 2,821,019; 3,171,200; 2,799,929; 2,537,455; 915,611 and 115,157. However, in each of these arrangements, adjustment of the radius of the circle to be cut is difficult and requires the use of special inserts of a predetermined radius. This requires a large number of separate cutter elements, which is generally undesirable.

It is therefore, an object of the present invention to obviate or mitigate the above disadvantages.

According, therefore, to one aspect of the present invention there is provided a compass for sweeping a circle on a sheet of material, said compass comprising an annular base having a lower surface engageable with said material, a support member rotatably supported on said base, and a toolholder mounted on said support member and moveable therewith upon rotation of said member relative to said base to sweep an arc of circle, said toolholder having a toolpost to support a tool and permit movement thereof relative to said support member in a direction generally normal thereto between a first position and a second position to facilitate movement of a tool mounted in said holder toward said sheet of material.

It is preferred that the toolholder is radially adjustable relative to the support member to vary the diameter of the circle to be swept.

According to a further aspect of the present invention there is provided a compass for sweeping a circle on a sheet of material, said compass comprising an annular base having a lower surface engageable with said material, a support member rotatably supported on said base by a plurality of bearing members disposed in spaced relationship about the periphery of said support member and acting therebetween and a toolholder mounted on said support member and moveable therewith upon rotation of said member relative to said base to sweep an arc of a circle.

Preferably, each of the bearing members engages a pair of oppositely inclined surfaces to inhibit relative movement along the axis of rotation.

Embodiments of the invention will now be described by way of example only with reference to the accompanying drawings in which.

Figure 1:
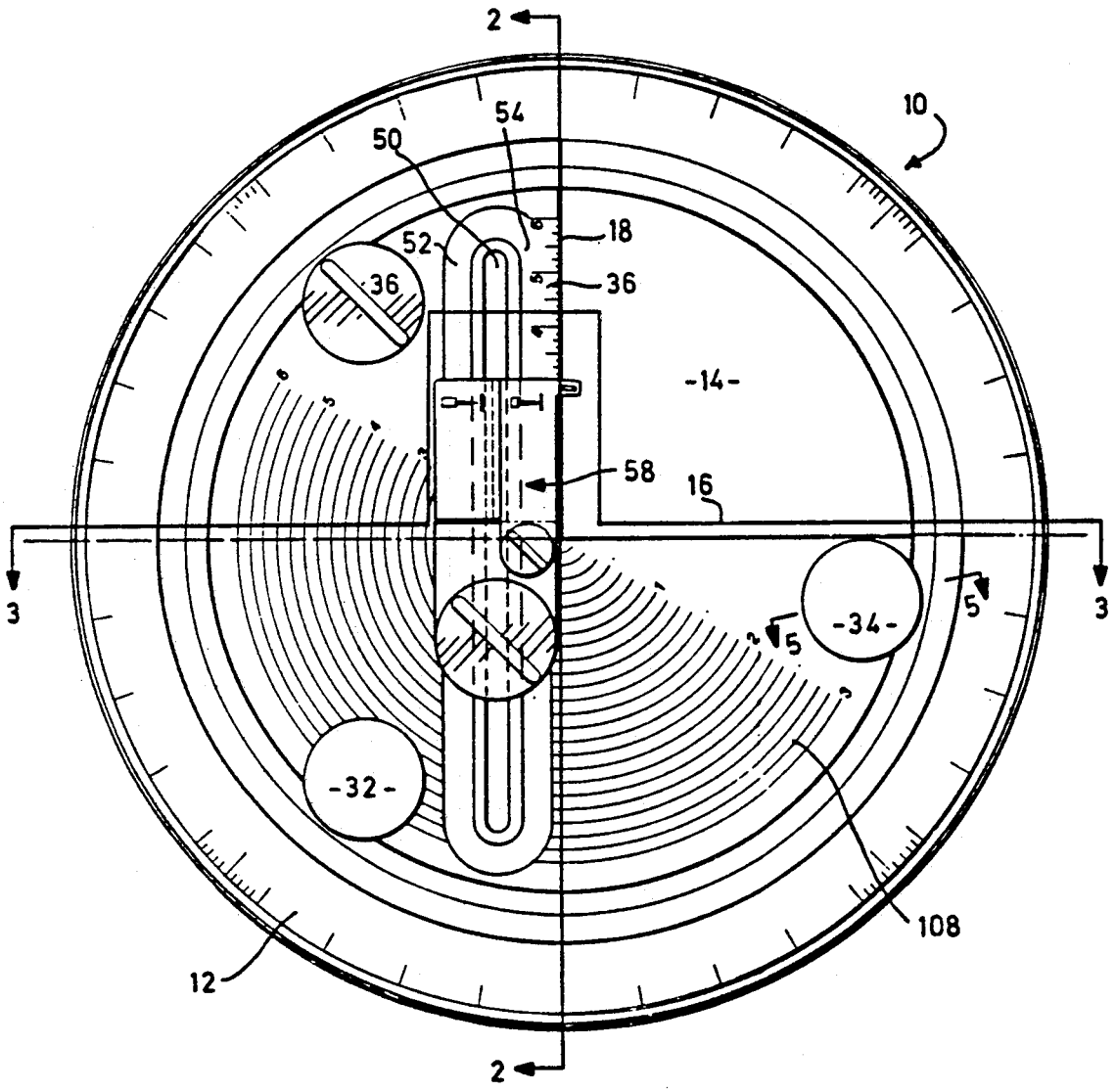
FIG. 1 is a plane view of a compass.
Figure 2:
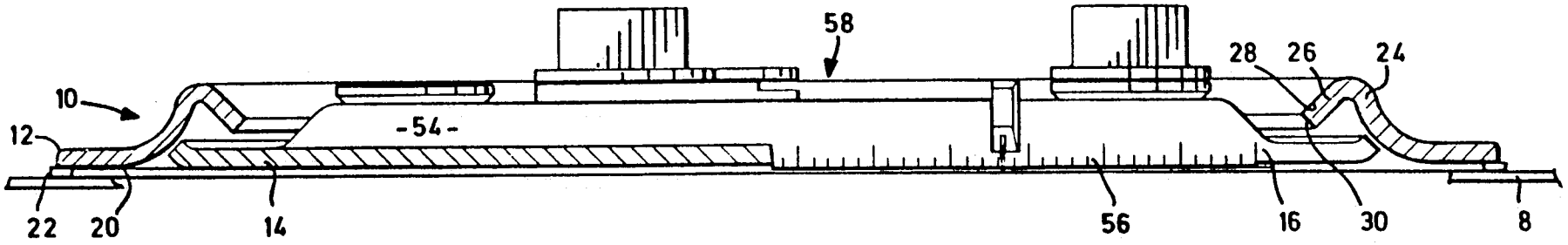
FIG. 2 is a view on the line 2—2 of FIG. 1.
Figure 3:
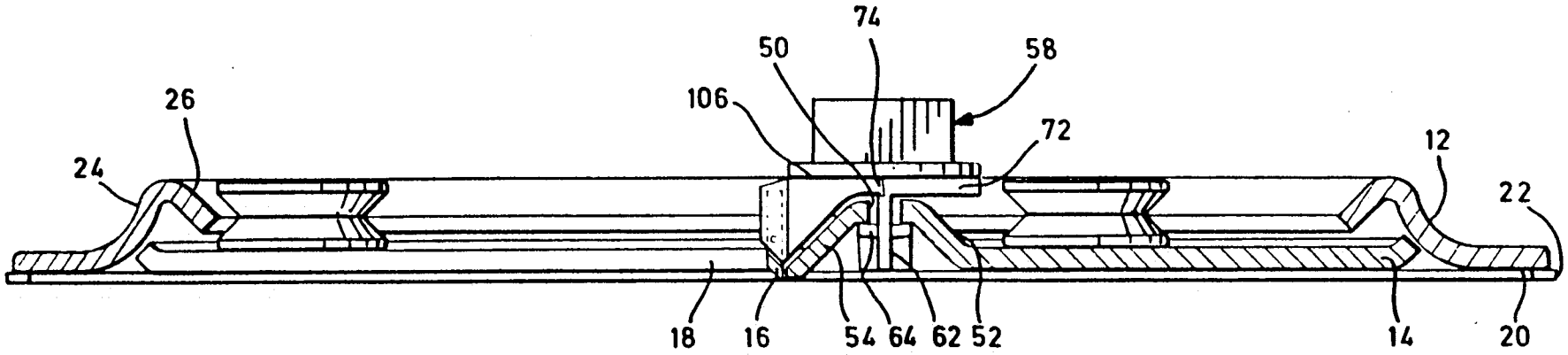
FIG. 3 is a view on the line 3—3 of FIG. 1.
Figures 4, 4A:
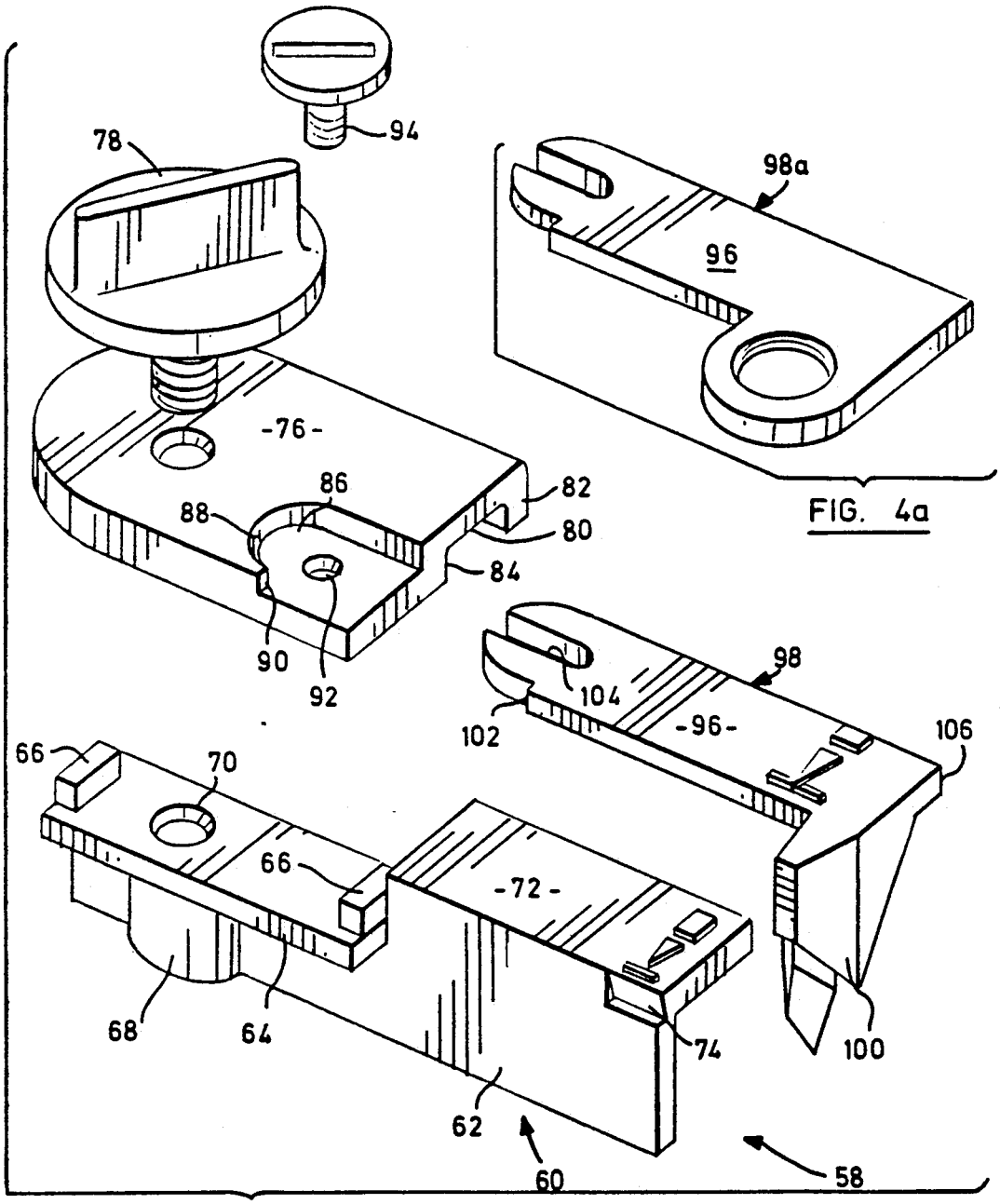
FIG. 4 is an exploded perspective view of a subassembly of the compass shown in FIG. 1.
Figure 6:
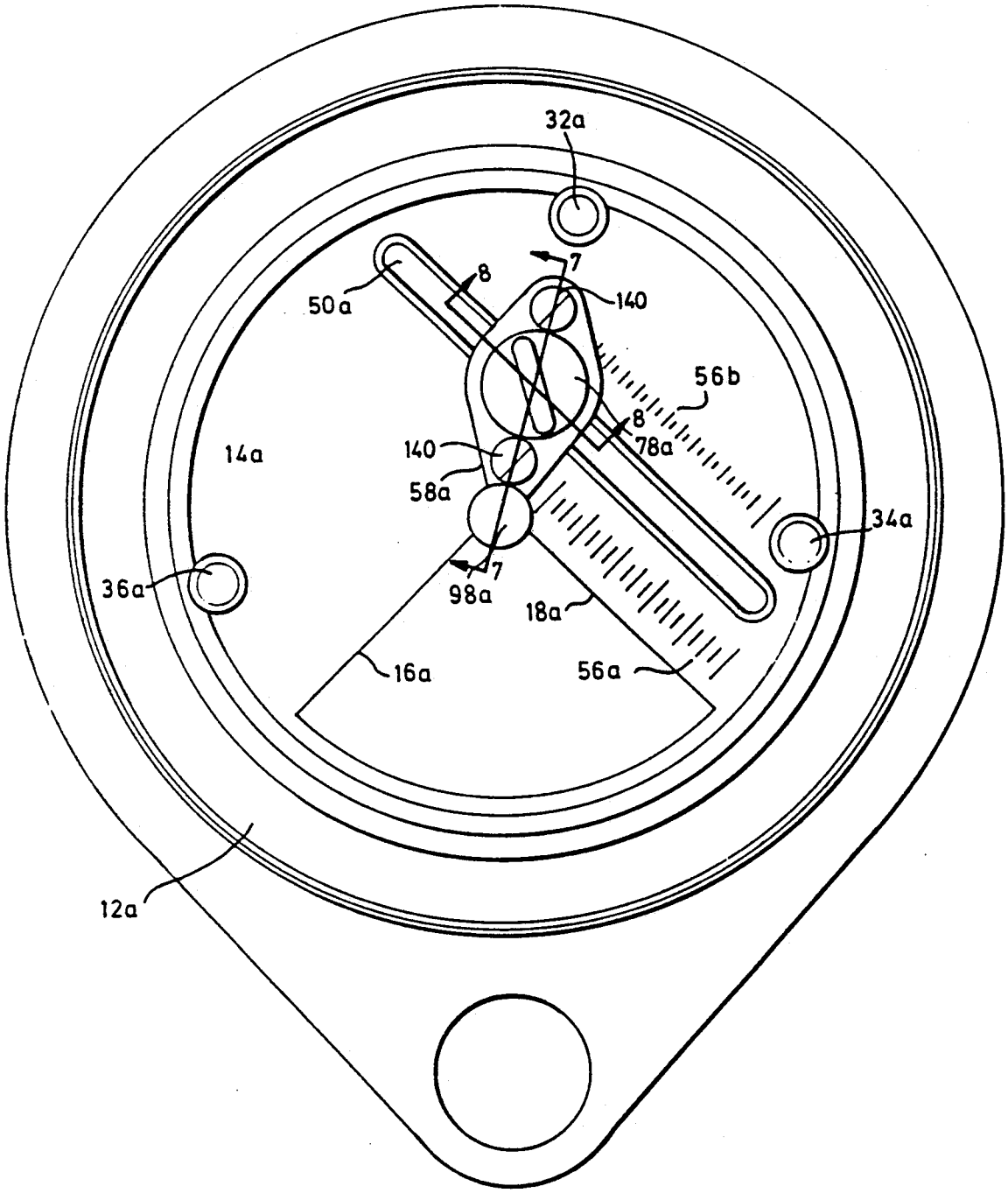
Figure 5:
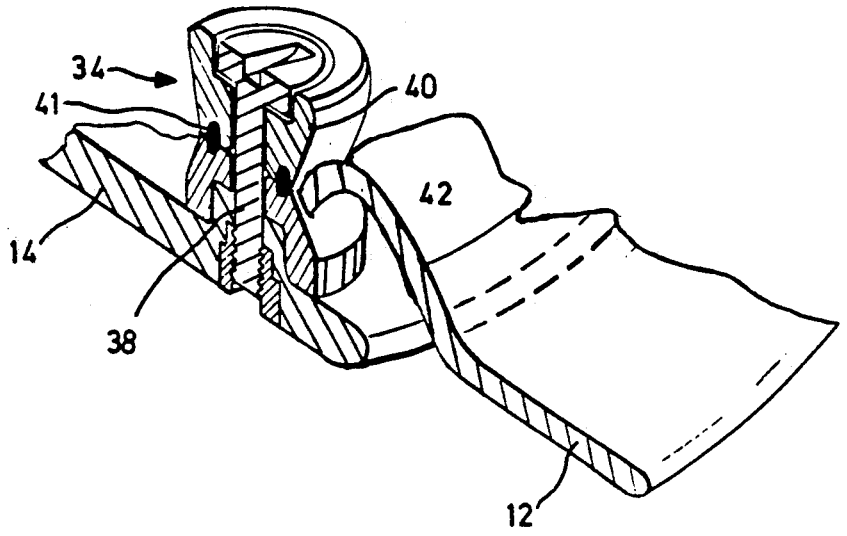
Figure 7:
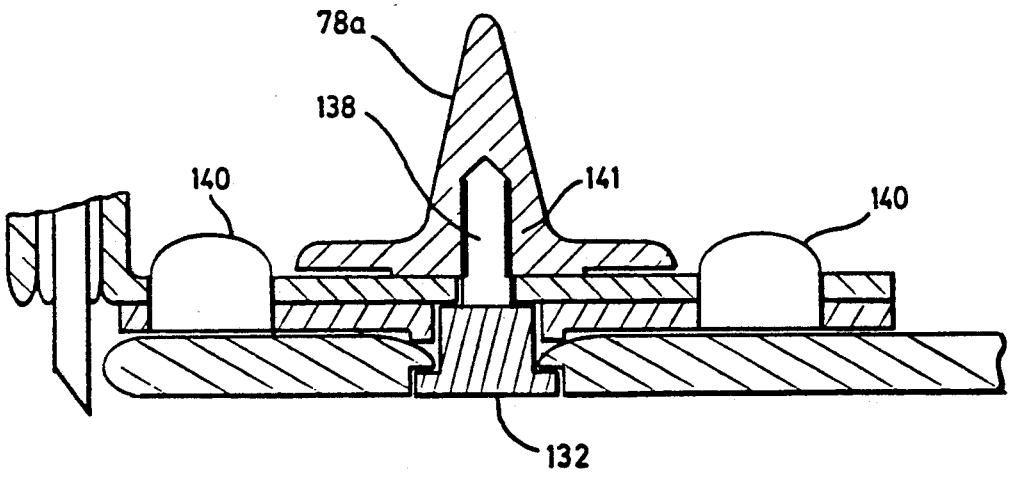
Figure 8:
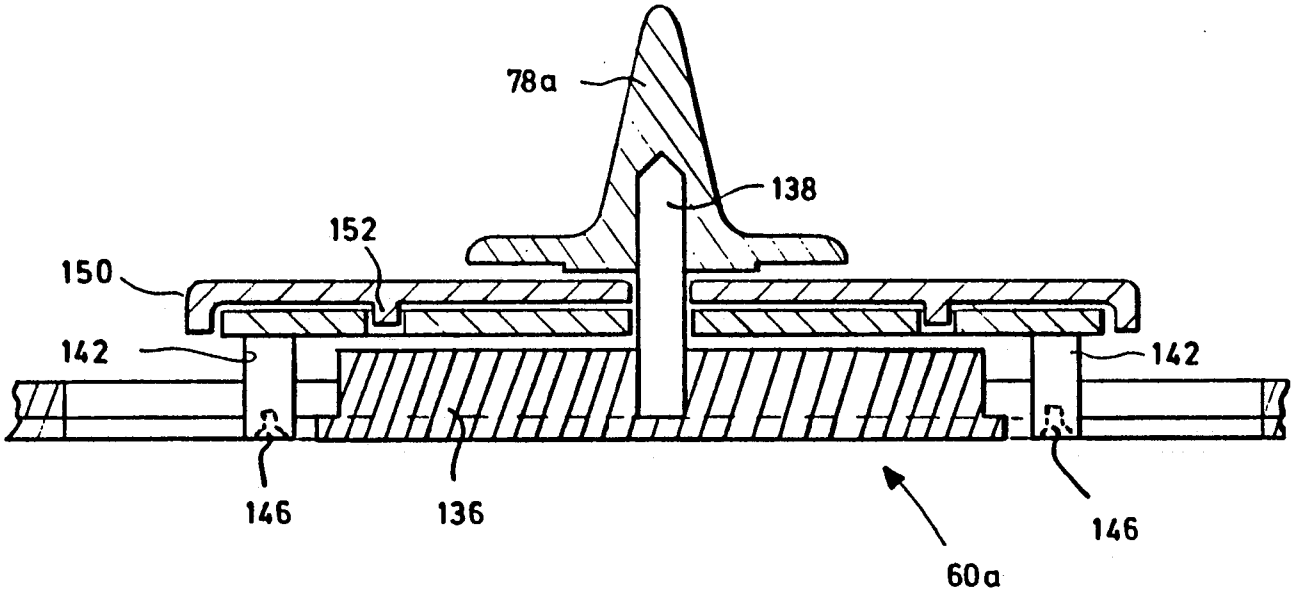
Figure 9:
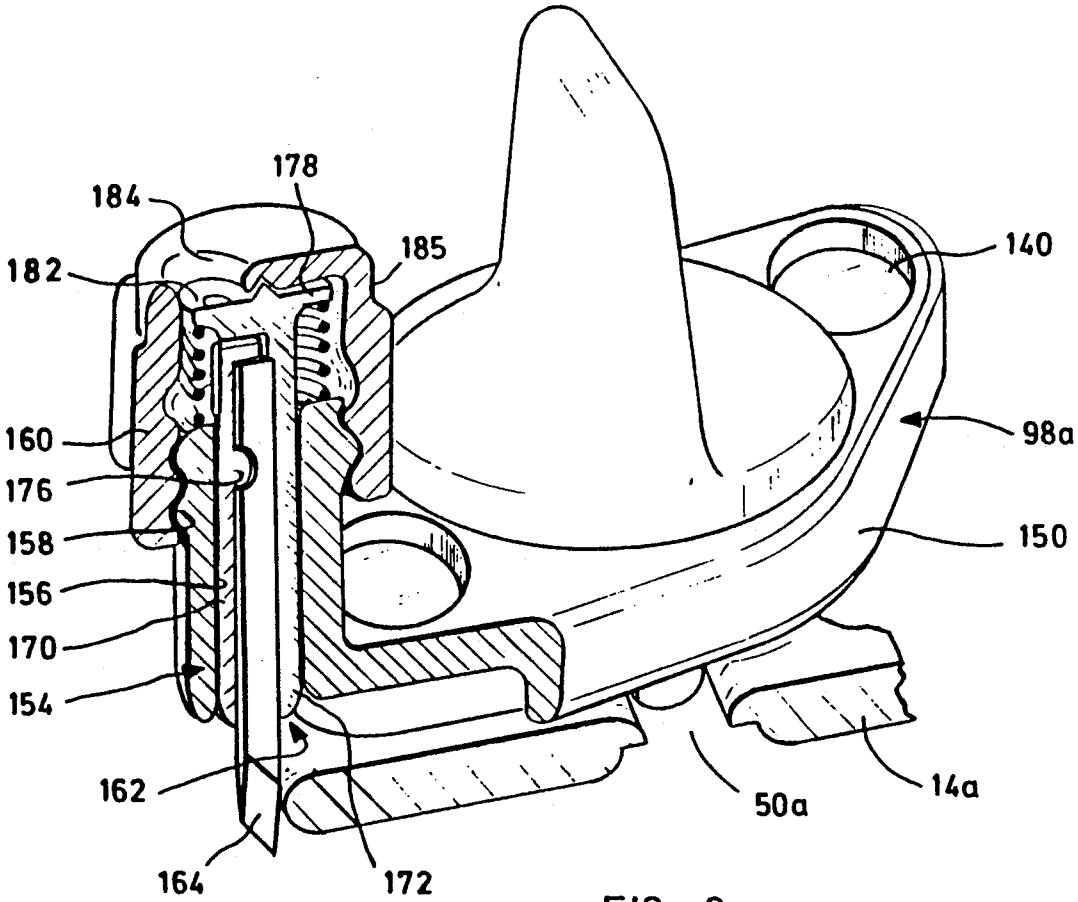
Figure 11:
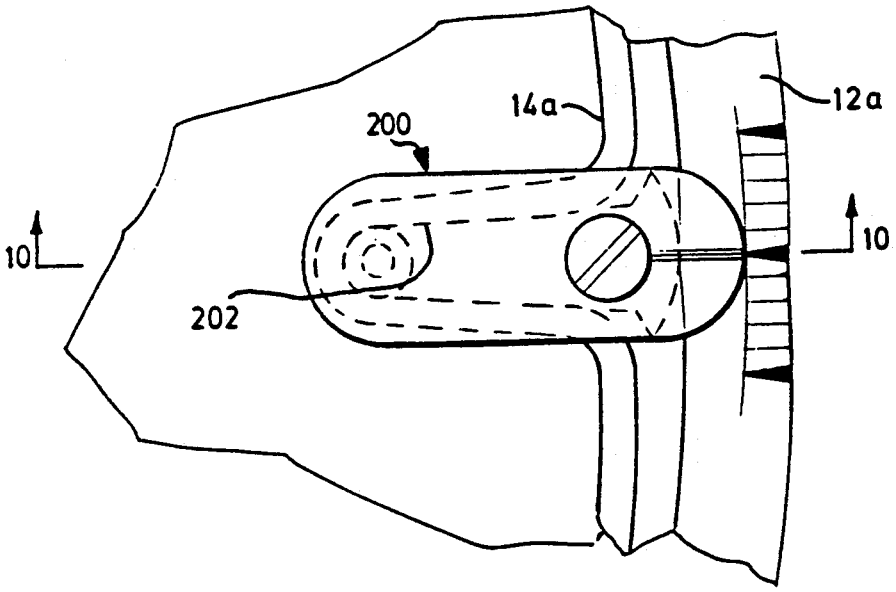
Figure 10:
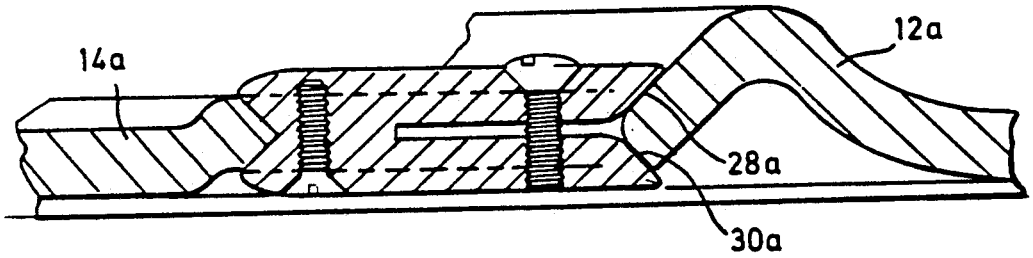
Figure 12:
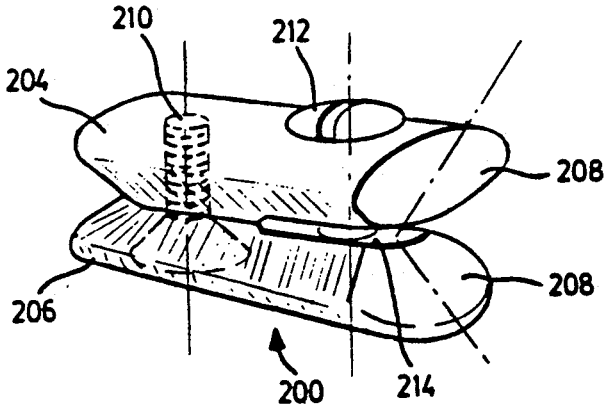
Figure 13:
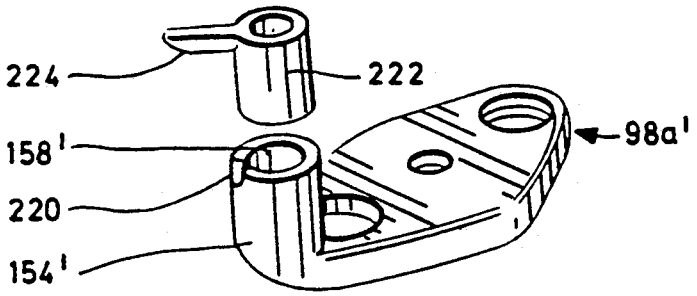
Figure 14:
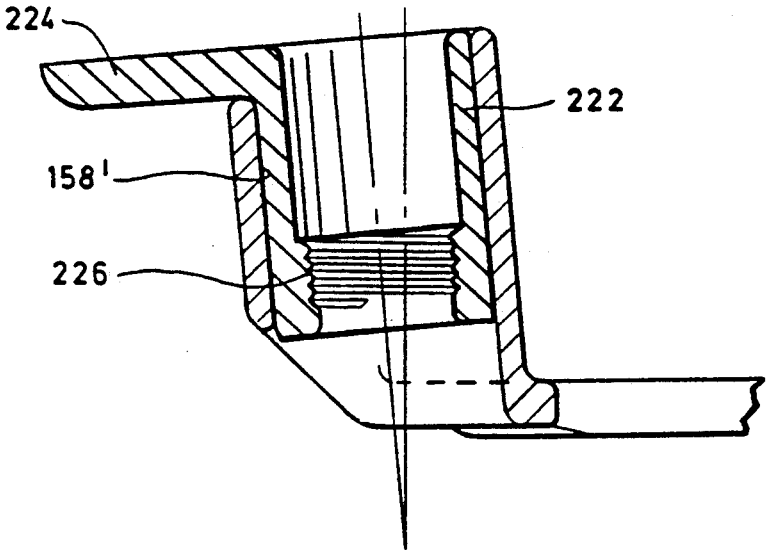

FIG. 4*a* is a view similar to FIG. 4 showing an alternative arrangement;

FIG. 5 is a perspective view partly in section taken along the line 5—5 of FIG. 1;

FIG. 6 is a plan view of an alternative embodiment of a compass;

FIG. 7 is a view on the line 7—7 of FIG. 6;

FIG. 8 is a view on the line 8—8 of FIG. 6;

FIG. 9 is a perspective view, partly in section of a component of the device shown in FIG. 6;

FIG. 10 is a view similar to FIG. 5 of an alternative embodiment of guide;

FIG. 11 is a plan view of the guide shown in FIG. 10;

FIG. 12 is a perspective view of the guide shown in FIG. 11;

FIG. 13 is an exploded perspective view of an alternative form of toolpost to that shown in FIG. 6;

FIG. 14 is a section of the assembled toolpost of FIG. 13.

Figure 15:
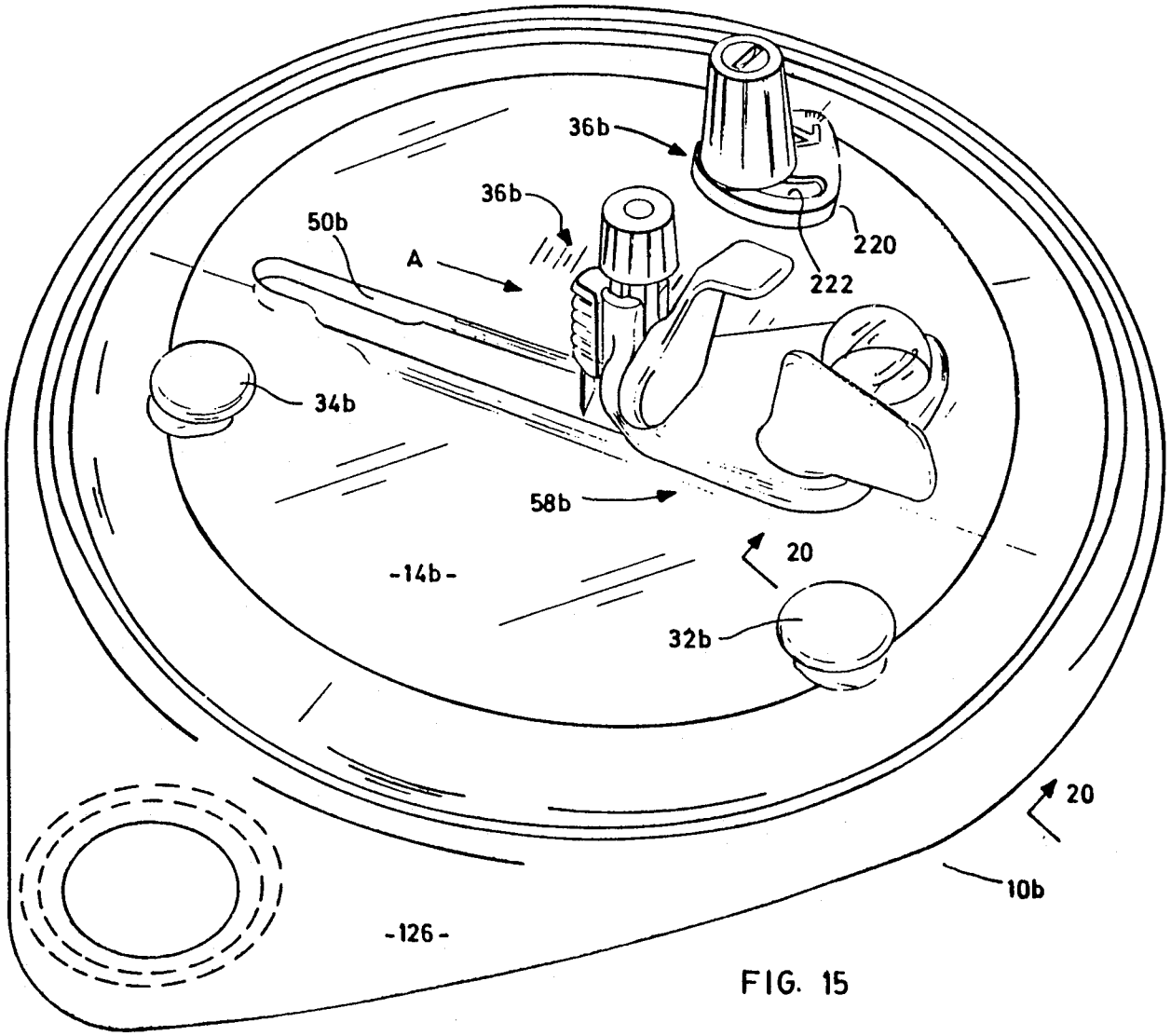
Figure 16:
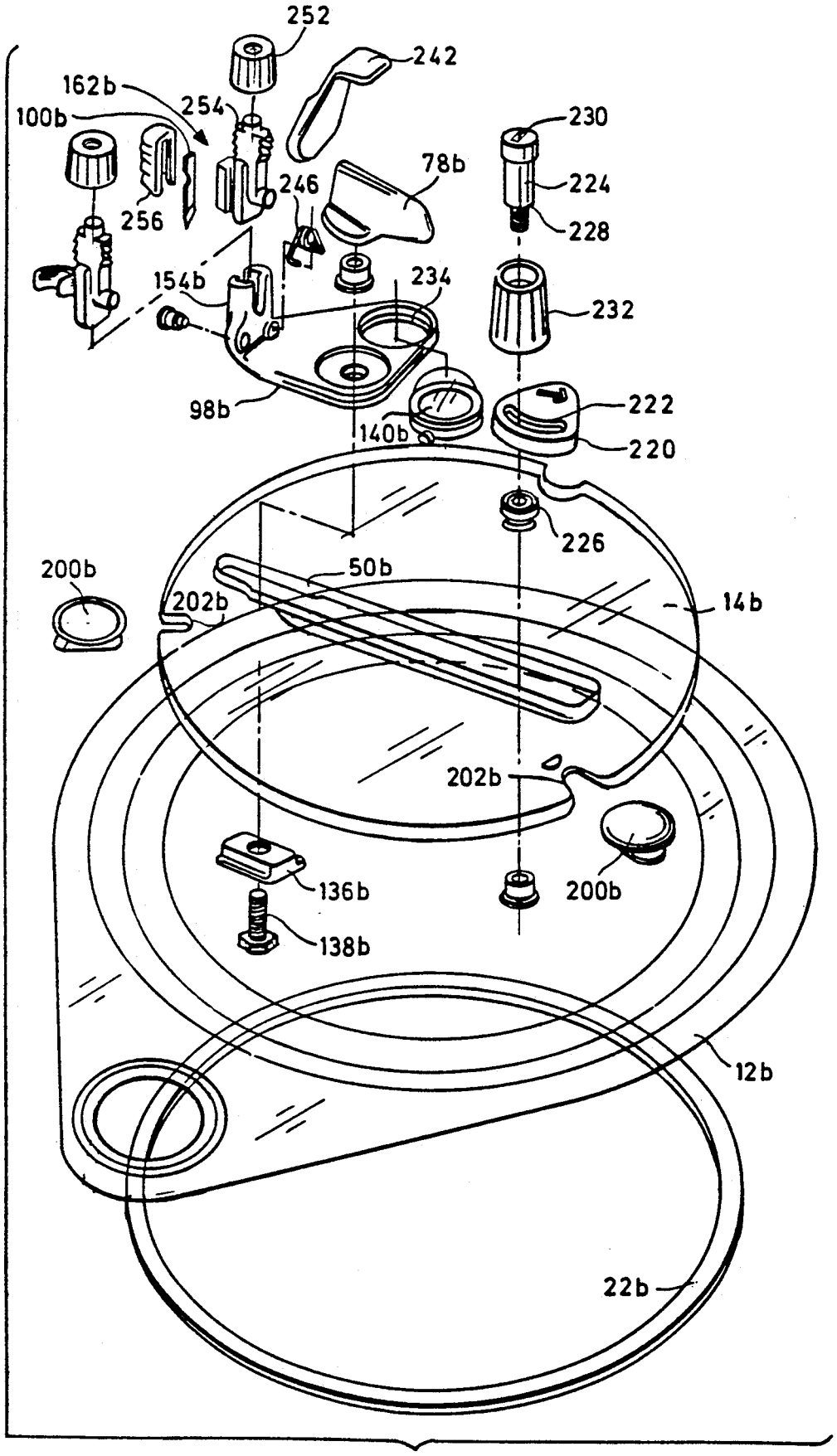
Figure 17:
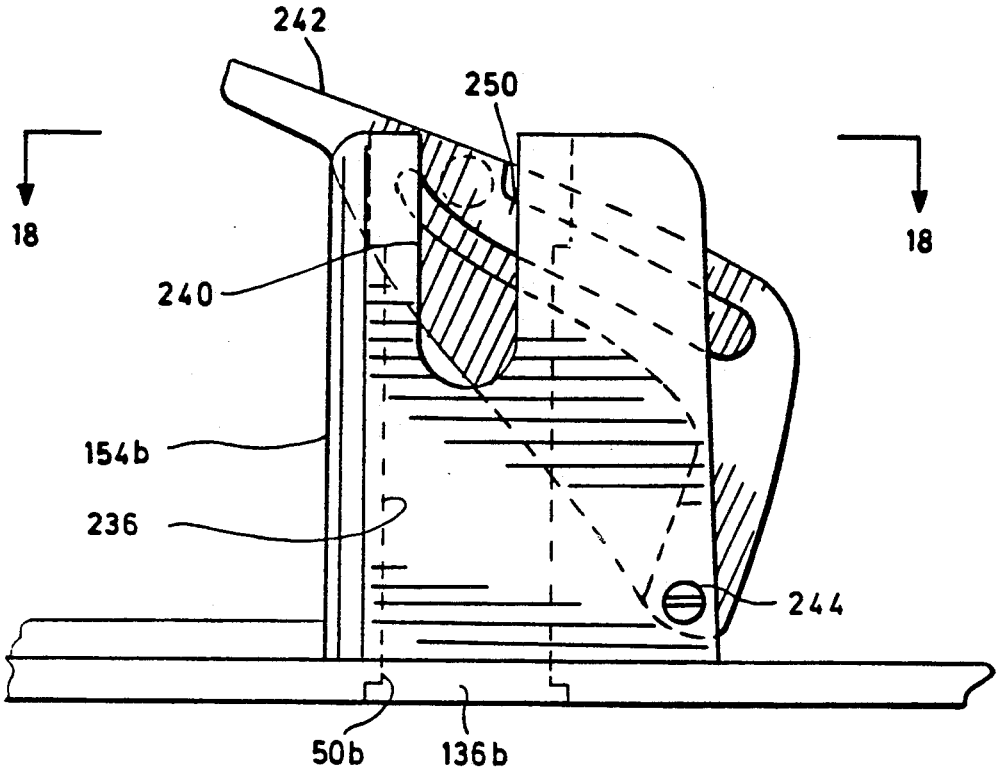
Figure 18:
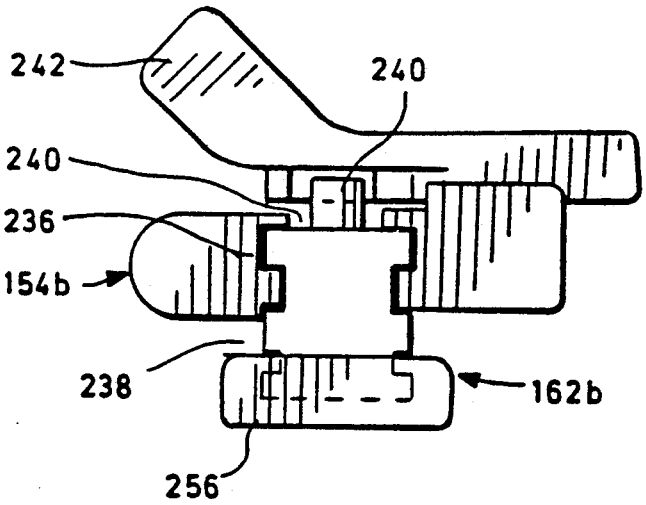
Figure 19:
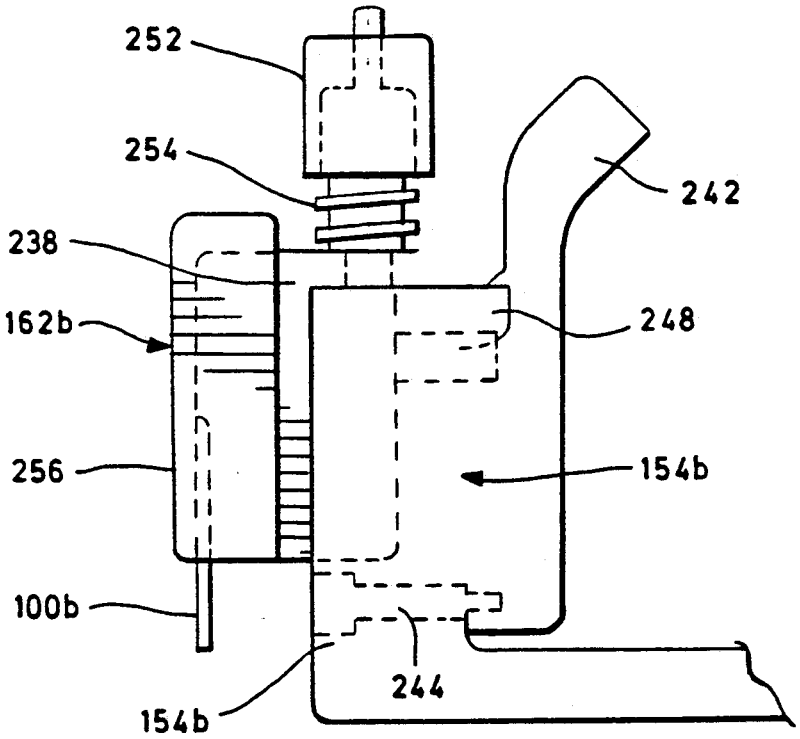
Figure 20:
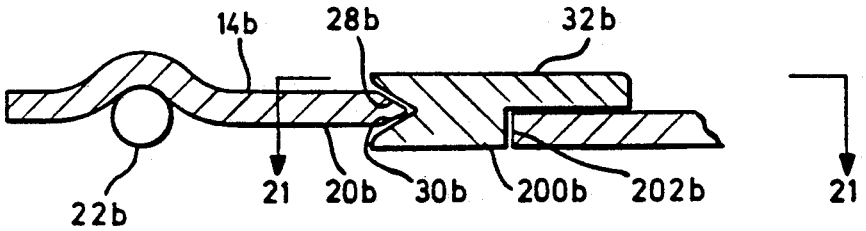
Figure 21:
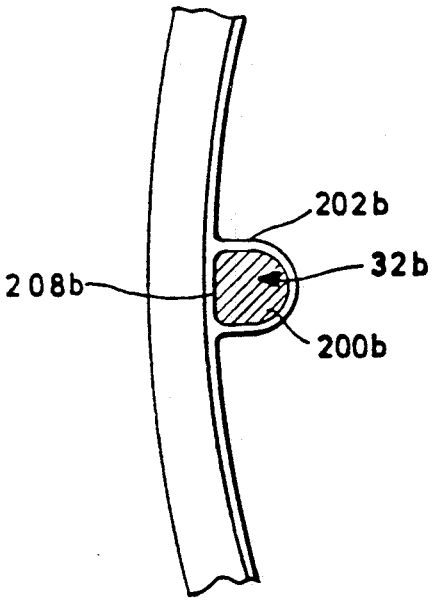

FIG. 15 is a perspective view of a further embodiment of compass;

FIG. 16 is an exploded view of the compass of FIG. 15 showing the components thereof;

FIG. 17 is a view in the direction of arrow A of FIG. 15;

FIG. 18 is a plan view of FIG. 17;

FIG. 19 is a front elevation of FIG. 17;

FIG. 20 is a view on the line 20—20 of FIG. 15;

FIG. 21 is a view on the line 21—21 of FIG. 20.

Referring to FIGS. 1 to 5, a compass 10 includes an annular base 12 and a support member 14. The support member 14 is generally circular with a quadrant removed to define radial edges 16, 18. The annular base 12 has a lower planar surface 20 with an annular neoprene gasket 22 secured to the surface 20 to provide a continuous, slightly resilient surface for engagement with a sheet of material indicated at S.

The base 12 includes a curved portion 24 which smoothly merges with a downwardly inclined section 26. The section 26 has an upper surface 28 and a lower surface 30 to define a pair of oppositely inclined support surfaces.

The support member 14 is rotatably supported on the base 12 through a set of bearings 32, 34, 36, respectively, which provide a low friction bearing. Each of the bearings 32, 34, 36 includes a spindle 38 screwed into a threaded boss 39 on the support member 14 and a pair of body members 40, 42 rotatably mounted on the spindle 38. The body members 40, 42 are biased apart by a resilient o-ring 41 to permit adjustment of the reactive disposition of the body members by rotation of the spindle 38.

Each of the body members 40. 42 is a frustoconical shape so that the outer surface of each of the rollers is complementary to the surfaces 28, 30. One of the bearings, bearing 36, also includes an upwardly extending web 44 to facilitate rotation of the roller member 36.

The support member 14 is also provided with an elongate slot 50 formed between a pair of upwardly converging walls 52, 54 integrally formed with the support member 14. The wall 52 terminates at the radial edge 18 and carries a scale 56. A toolholder 58 is located in the slot 50 and is best seen in FIG. 4.

The toolholder includes a slide 60 having a central web 62 and a laterally projecting flange 64. A pair of upstanding projections 66 are formed on the upper surface of the flange 64 and have a width corresponding to the width of the slot 50. An enlarged boss 68 is formed on the web 62 to accommodate a threaded bore 70 that extends to the upper surface of the flange 64. The web projects upwardly beyond the flange 64 and is integrally formed with a tab 72 that projects laterally to one side of the web 62. A recess 74 is formed at the intersection of the tab 72 and web 62 at one end of the web.

The tab 72 and upstanding portion of the web 62 pass through the slot 50 with the projection 66 located within the slot. A retainer 76 is secured to the slide 60 by a thumbscrew 78 that is received in the threaded bore 70. The retainer 76 includes a recess 80 on its underside so that downwardly depending lips 82, 84 engage the inclined walls 52, 54 and locate the toolholder on the slot. The upper surface of the retainer 76 is formed with a rabbet 86 at one edge which includes a semi-circular wall 88 and a shoulder 90. A threaded bore 92 is formed in the floor of the rabbet 86 to receive a screw 94. The rabbet 86 receives a slotted tongue 96 of a radially extending toolpost 98 that has a knife blade 100 integrally molded at one end and depending from the toolpost 98. The tongue 96 is of complementary shape to the rabbet 86 to have a shoulder 102 to abut the shoulder 90 with a radial slot 104 to accommodate the screw 94.

As can best be seen in FIG. 4, the rear edge of the toolpost 98 has a projection 106 of complementary shape to the recess 74 so that the projection 106 and recess 74 constitute a detent between the toolpost 98 and the web 62.

The base 12 and support member 14 are each formed from a clear plastics material to allow an unobstructed view of the material upon which the compass is being placed. The support member 14 also has concentric circles indicated at 108 to assist in centering the compasss in the desired location on the material.

In operation, the compass is placed on the sheet material to be cut and the knife 100 positioned at the appropriate radius. The scale 56 is half full size so that the knife 100 may be positioned to produce a circle of the diameter indicated on the scale. To adjust the knife, the thumbscrew 78 is loosened and the toolholder assembly slid along the slot 50. It will be noted that the slot 50 is displaced to one side of a diameter of the circle so that the knife blade 100 may be positioned on the diameter. Once the correct position is attained, the thumbscrew 78 is tightened. During this adjustment, the toolpost 98 is in a raised position so that the knife-edge 100 does not engage the material to be cut. The toolbar 98 is formed so that in its at-rest position the projection 106 is positioned above the upper surface of the tab 72. With the knife in position, the toolbar 98 is depressed by application of a force adjacent to the knife blade so that the projection 106 engages with the undercut recess 74 to hold the knife in a lowered position.

The knife may then be advanced to sweep the arc of a circle by rotating the roller 36 through the tab which causes the support member to be rotated relative to the base. It has been found that when cutting fine materials an improved cut is achieved by arranging the knife blade on the chord of a circle 20 rather than tangential to the circle. In practice, a 5 degree offset from the tangent of the circle to be cut has been found satisfactory.

Once the required arc has been cut, which may in fact be a complete circle, the knife blade is released by depressing on the rear edge of the tab 72 so that the toolpost 98 springs back to an elevated position. The compass may then be removed.

The provision of the two inclined surfaces 28, 30 on the base and the complementary shape of the rollers 32, 34, 36, inhibits movement of the support member along the axis of rotation and at the same time provides an easily rotatable support member. The particular formation of the rollers with the two frustoconical portions 40, 42 also ensures that the incline guide surfaces are not damaged in the event that the compass is dropped as the two parts will tend to flex apart rather than nick the support surfaces. The o-ring 41 also allows a snug fit on the inclined surfaces 28, 30 to accommodate inevitable minor variations in dimensions during manufacture.

If desired, and as shown, the concave face of 24 of the base 12 may be provided with a protractor 10 marking with a cursor on the periphery of the support member 14. In this way the included angle of the arc to be swept can readily be ascertained.

It will be observed that the removal of the quadrant from the support member provides ready access to the material and combines with the offset position of the toolholder so that the centre of the circle to be swept can readily be identified.

As may be seen from FIG. 4*a*, the toolpost 98 incorporating a knife 100 may be replaced with a toolpost 98*a* to receive a conventional drawing instrument such as a pen or pencil so that the compass may be used to mark rather than cut circles. Again, the toolpost 98, through its inherent flexibility will permit movement between an elevated and lowered position so that the pen or drawing instrument may be moved into engagement with the material once the radius to be swept has been adjusted. It will be apparent that the toolpost 98 may be removed by simply releasing the screw 94 allowing the toolpost to be said radially from the cap 76. The shoulder 90 and 102 are operable to prevent rotation of the 'toolpost about the thumbscrew 94 and therefore ensure an accurate reproduction of the circle to be swept.

A second embodiment of the compass is shown in FIGS. 6–9 and in view of the similarity between certain components of the two embodiments, like reference numerals will be used in each with the suffix 'a' added for clarity when referring to the second embodiments.

Referring therefore to FIG. 6, a compass 10*a* includes an annular base 12*a* and support member 14*a*. The base 12*a* is identical to that shown in FIGS. 1–4 and therefore will not be described in any further detail.

The support member 14*a* is generally similar to that shown in FIGS. 1 to 5 and includes a pair of radial edges 16*a*, 18*a*. Rollers 32*a*, 34*a*, 36*a* rotatably support the member 14*a* on the base 12*a* with one of the rollers, 32*a* having a freely rotating knob a projecting upwardly.

An elongate slot 50*a* is formed in the support member 14*a* and disposed to one side of the diameter of the support member. Unlike the embodiment of FIGS. 1–4, the upper surface of the support member 14*a* is generally planar. A pair of scales 56*a* and 56*b* are formed on the support member 14*a* to either side of the slot 50.

As best seen in FIGS. 7 and 8, a toolholder 58*a* is slidably mounted in the slot 50*a* and includes a slide 60*a* and a retainer 76*a* and toolpost 98*a*. The slide 60*a* includes a base member 132 with a central web 136 projecting into the slot 50*a*.

The web 136 is formed with a pair of cylindrical ends to produce a dumbbell shape so that line contact is made with the edges of the slot 50*a*. A threaded rod 138 projects upwardly from the web and is received in a threaded base 141 of a thumbscrew 78*a*. The web 136 also projects through a retainer 76*a* that overlies the upper surface of support member 14*a*. The retainer 76*a* is of diamond shape and carries a pair of lenses 140 that are integrally molded with the retainer 76*a*. A lens is positioned over each of the scales 56*a* and 56*b* to magnify them. Rotation of the retainer 76*a* is inhibited by a pair of pins 142 that depend from the retainer and engage the slot 50*a* at longitudinally spaced locations. A snug fit is provided between the pins 142 and slot 50*a* by screws 146 that have a flared head and are received in the lower end of the pins 142. The lower ends of pins 142 are slit along their axis so that as the screws 146 are tightened the flared head causes the pins 142 to spread. The toolpost 98*a* is mounted on the rod 138 above the retainer 76*a* and has apertures 148 to allow passage of the lenses 140. The periphery of the toolpost 98*a* is formed as a skirt 150 and a pair of pins 152 extend from the toolpost to the retainer to maintain alignment of the toolpost.

An upstanding boss 154 is formed at the apex of the toolpost 98*a* adjacent to the edge 18*a* with a cylindrical bore 156 extending through the boss. The external surface of the boss is formed with a thread 158 that receives a cap 160. A knife assembly 162 is located within the bore 156 and has a knife blade 164 supported in an elongate slot 166 in a carrier 168. The carrier 168 is formed from a pair of semi-cylindrical components 170, 172, one of which, 170, has the elongate slot 166 to receive the knife blade 164. A pair of complementary projections 176 inhibit relative longitudinal movement of the blade and carrier. The component 172 of carrier 168 is formed 5 with an enlarged head 178 having a conical protrusion 180 that bears against the underside of cap 160. Indicia 182 are formed on the upper surface of head 178 and may be received through an aperture 184 in the cap 160. A spring 185 acts between the upper surface of boss 154 and the underside of head 178 to hold the head 178 and therefore carrier 168 against cap 160. It will be noted that the knife blade 164 is of square cross section with one side bearing against the radial edge 18*a* to inhibit rotation of the blade.

In operation, the radial position of the blade 164 is adjusted by releasing the thumb screws 78*a* and sliding the toolholder 58*a* to the required position. The lenses 140 magnify the scales to facilitate positioning.

The blade may then be moved into engagement with the sheet materials by rotation of the cap 160 that causes movement of the carrier 168 against the bias of spring 184 within the boss 154. As noted above, rotation of the blade is inhibited by the radial edge 18*a*. The indicia 182 are spaced to provide uniform incremental vertical movement of the blade 164 so that the depth of cut can be accurately selected.

The support 14*a* is then rotated by means of the knob 33*a* to sweep the required arc.

An alternative form of support between the 35 base and support members 12*a*, 14*a* and the rollers shown in FIG. 5 is shown in FIGS. 10–12.

The support member 14*a* is rotatably supported on the base 12*a* by a plurality of Delrin (trademark) bullets 200. The bullets 200 are received in notches 202 formed in the periphery of the support member 14*a* and include upper and lower members 204, 206, respectively. Each of the members 204, 206 is identical in shape and has a prismatic cross-section with a convex upper surface. The radially outer end is formed as a part spherical surface indicated at 208. The two portions 204, 206 are secured together by a pair of countersunk screws 210, 212. It will be noted that the opposed surfaces are relieved as indicated at 214 adjacent the spherical surface 208 so that the two surfaces are spaced apart. In this manner the spacing between the surfaces may be adjusted by means of screw 212. As will be evident from FIG. 10, the opposed curved surfaces 208 engage oppositely inclined upper and lower surfaces 28*a*, 30*a*, with the spherical surface 208 providing a line contact. A snug fit is ensured by adjustment of the screw 212, which also acts to centre the support member 14*a* in the base 12*a*. In this manner a low friction bearing is provided between the support member and the base.

An alternative form of toolpost 98*a* is shown in FIGS. 13 and 14 to permit use of a drawing pen rather than a knife as shown in FIGS. 6 to 9. Common reference numerals will be used with a ′ added for clarity.

Toolpost 98*a*′ is provided with an upstanding boss 154′. A notch 220 is formed in the upper edge of boss 154′ and extends partially along the axis of the boss 154′. A pen holder 222 is slidably mounted within the bore 158′ and has a radially extending handle 224 projecting from its upper edge. The handle 224 is dimensioned to be slidable within the notch 220.

The pen holder 222 has a threaded bore 226 at its lower and to receive a conventional drawing pen. The axis of the bore 158′ is aligned slightly from the vertical so that the tip of a pin threaded into the holder 222 will be adjacent radial edge 18*a*′. The pen may be moved in and out of engagement with the surface of the sheet material by moving the handle 224 along the notch 220 and may be maintained in an elevated position by rotation of the holder 222 so that the handle 224 is supported on the upper edge of boss 154′.

The holder 222 is smoothly slidable in the bore 158′ so that unintentional movement of the pen is avoided whilst an arc is being drawn.

It will be observed in both embodiments that a simple yet effective compass is provided that allows circles to be drawn or cut without marking the material within the circle whilst providing ready adjustment and fine precision of the circles.

A further embodiment of the compass is shown in FIGS. 15 through 21 that is similar in many respects to that shown in the embodiments of FIGS. 1 through 14. Accordingly, similar components will be identified with like reference numerals with a suffix B added as appropriate for clarity.

Referring therefore to FIGS. 15 and 16, the compass 10B includes a base 12B and a rotatable support 14B. Bearings 32B, 34B and 36B provide appropriate support and smooth rotation of the support 14B in the base 12B.

As shown in more detail in FIGS. 20 and 21, the bearings 32B, 34B and 36B are in the form of molded bullets 200B located within semi-circular notches 202B. The front face of each of the bullets 200B is formed as a pair of inclined convex surfaces 208B to conform to the incline surfaces 28B, 30B formed on the radially inner periphery of the base 14B. The bullets therefore essentially make a line contact with the incline surfaces 28B and 30B.

To provide for adjustment of the bearings 32B, 34B and 36B, provision is made for adjustment of the bullet 200B associated with bearing 36B. As can be seen in FIGS. 15 and 16, the upper edge of bullet 200B is formed with an overlying flange 220 that has an arcuate slot 222 formed in it and centred on the centre of curvature of the semi-circular notch 202B. A threaded pin 224 extends through the slot and into an aperture 226 formed in the base 14B. The pin 224 has a shoulder 228 that bears against the upper edge of the flange 220 to clamp the flange and inhibit movement of the bullet 200. The pin may be tightened to increase the clamping force by means of the slot 230 formed in the end of the pin to receive a screwdriver. The pin 224 also serves to locate a knob 232 that is freely rotatable on the pin 224 and facilitates rotation of the support 14B relative to the base 12B.

To ensure smooth rotation without play, the bullet 200B associated with the bearing 36B may be rotated through manipulation of the flange 220 to adjust the point of contact of the convex surface 208 on the incline surfaces 28B, 30B. Because of the larger diameter of convex surface 208, it will be apparent that rotation of the bullet 200B from the mid-point will move the surface 208 radially outwardly and so take up any play in the bearings.

The toolholder 58B is secured in the slot 50B by means of a central web 136B that locates in the undercut surfaces of the slot 50B and attaches to a thumbscrew 78B by means of the threaded rod 138B. The toolpost 98B is generally triangular and has an aperture 232 to accommodate a magnifying lens 140B. A boss 154B is formed at one apex of the toolpost 98B to accommodate a knife assembly 162B.

As may best be seen in FIGS. 17 through 19, the boss 154B is formed with a vertically extending undercut channel 236 to accommodate a knifeholder 238. A pin 240 projects rearwardly from the knifeholder 238 and passes through vertical slot 242 formed in the rear face of the boss 154B.

Movement of the knifeholder 238 along the channel 236 is controlled by a lever 242. The lever 242 is secured by a pin 244 to the boss 154B to permit pivotal movement of the lever 242 relative to the boss. A spring 246 acts between the lever 242 and the boss 154B to bias the lever 242 to the upper position as shown in FIG. 17. A projection 248 integrally formed at the upper end of the boss 154B inhibits upward movement of the lever 242. A camtrack 250 is formed on the inner face of the lever 242 to receive the pin 240. The camtrack 250 comprises a pair of spaced flanks 251 that snugly receive the pin 240. In the upper position of the lever 242 as shown in FIG. 17, the pin 240 is positioned at the entrance to the camtrack 250 and permits upward movement of the knifeholder 238 to allow it to be removed from the channel 236. Downward movement of the lever 242 causes the pin 240 to be engaged by the camtrack 250 and moves the knifeholder vertically 238 downward to move the knife blade 100B into engagement with the surface of the material to be cut. The vertical position of the knife blade 100 is adjusted by means of a stop 252 mounted on a threaded projection 254 of the knifeholder 238. The stop 252 engages the upper surface of the boss 154B to inhibit further downward movement as the lever 242 is pivoted to move the knifeholder vertically downwardly. Rotation of the stop 252 on the threads will of course adjust the extent of vertical movement of the knifeholder.

The knifeholder 258 includes the knife blade 100B held in place by a cap 256 that slides into an undercut channel on the knifeholder 238. The knife 100B is thus securely located but the cap 256 may be slid upwardly to permit removal of the knife blade and replacement with a different blade. A semicircular recess of the blade locates it within the holder in a manner similar to the configuration of the knife retention system shown in FIG. 9.

The operation of the compass is similar to that described above with adjustment being provided by movement along the slot 50B and vertical movement of the tool being controlled through the lever 242. Although a knife assembly 162B has been shown, it will be apparent that a similar configuration of holder 238 may be used with an attachment to permit a pen or pencil to be mounted on the tool post 98B. The use of the camtrack 250 provides precise control of the movement of the tool at the same time facilitating removal of one type of tool and replacement with another. The snug fit of pin 240 in the camtrack 250 also inhibits vertical movement of the knife assembly 162 relative to the boss for precise control.

We claim:

1. A compass for sweeping an arc of a circle on a target material comprising:

a base having a lower surface engagable with said material;

a support member rotatably supported on said base;

a toolholder mounted on said support member and being moveable therewith to sweep an arc of a circle upon rotation of said support member about an axis relative to said base, said toolholder including radial adjustment means permitting the radial position of said toolholder with respect to said axis to be varied;

a toolpost mounted on said toolholder for supporting a tool, said toolpost permitting movement of said tool relative to said support member in a direction generally normal thereto between an operative position wherein said tool extends beyond said lower surface to contact said material and an inoperable position wherein said tool is retracted from said lower surface; and depth adjustment means allowing the position of said tool in said operative position to be varied, said depth adjustment means being operable independently of said radial adjustment means such that the position of said tool in said operative position does not change when the radial position of said toolholder is adjusted.

2. A compass according to claim 1 wherein movement of said tool between said operative and inoperative positions relative to said support member is controlled by cam means.

3. A compass according to claim 2 wherein said toolpost includes an upper threaded portion, said depth adjustment means being in the form of a stop threadably engaged and moveable along said threaded portion to permit the position of said tool in said operative position to be adjusted.

4. A compass according to claim 3 wherein said toolholder includes a lever pivotally secured to said toolpost, said cam means being formed on said lever such that actuation of said lever moves said toolpost between said operative and inoperative positions.

5. A compass according to claim 1 wherein said radial adjustment means includes a track formed on said support member to guide said toolholder during movement thereof to change said radial position.

6. A compass according to claim 5 wherein said radial adjustment means further includes a slide mounted on said toolholder cooperating with said track and lock means acting between said slide and said support member to inhibit radial movement of said toolholder.

7. A compass according to claim 6 wherein spaced abutments act between said track and said slide to inhibit rotation of said slide relative to said support member.

8. A compass according to claim 1 wherein a knife having a cutting edge is mounted on said toolholder.

9. A compass according to claim 8 wherein the cutting edge of said knife defines a chord of a circle to be cut.

10. A compass according to claim 1 wherein said base is annular and wherein said support member and said base are maintained in spaced relationship by a plurality of bearing members spaced about the periphery of said support member.

11. A compass according to claim 10 wherein each of said bearing members engages on a pair of oppositively inclined surfaces to inhibit relative movement thereof along the axis of rotation.

12. A compass according to claim 11 wherein said bearing members are mounted on said support member and engage the radially inner periphery of said base.

13. A compass according to claim 12 wherein each of said bearing members includes a pair of opposed convex surfaces disposed to engage respective ones of said inclined surfaces along a line of contact.

14. A compass according to claim 13 wherein adjustment means are provided to adjust the spacing between said convex surfaces.

15. A compass according to claim 13 wherein each of said bearing members is received in a notch formed in said support member.

16. A compass according to claim 12 wherein said bearing members are rollers.

17. A compass according to claim 16 wherein an actuator is formed on one of said rollers to facilitate rotation of said support member.

18. A compass according to claim 1 wherein a scale is formed to one side of said track parallel thereto and said toolholder carries an indicator positioned above said track.

19. A compass according to claim 7 wherein said track includes a slot formed in said support member and said abutments are bosses projecting from said slide into said slot.

20. A compass according to claim 19 wherein said bosses include wedge members to vary the diameter of said bosses.

21. A compass according to claim 1 wherein a knife is mounted on said toolholder, said knife including a blade mounted in a holder received in said toolpost, said holder including a stop operable on said blade to oppose movement between said blade and said holder relative to said toolpost.

22. A compass according to claim 1 wherein a segment of said support member is removed to provide a pair of free edges to permit a tool mounted on said toolholder to move along one of said free edges to engage said material.

23. A compass according to claim 12 wherein said bearing members each comprises a pair of elements resiliently biased apart.

24. A compass according to claim 16 wherein a knob is provided on one of said rollers to facilitate rotation of said support member and another of said bearing members is aligned radially therewith.

25. A compass according to claim 2 wherein said cam means are formed on a lever pivotally secured to said toolpost.

26. A compass according to claim 25 wherein said cam means includes a pair of spaced abutments to inhibit movement of said tool relative said lever in a direction normal to said support member.

* * * * *